United States Patent [19]

Pearce et al.

[11] 3,964,691

[45] June 22, 1976

[54] METHOD AND APPARATUS TO TREAT YARN

[75] Inventors: Larry N. Pearce; Grady H. Sanders, both of Spartanburg, S.C.

[73] Assignee: Deering Milliken Research Corporation, Spartanburg, S.C.

[22] Filed: Apr. 2, 1971

[21] Appl. No.: 130,585

Related U.S. Application Data

[62] Division of Ser. No. 776,534, Nov. 18, 1968, Pat. No. 3,618,184.

[52] U.S. Cl. ..... 242/47; 57/67; 242/83; 242/110.1

[51] Int. Cl.[2] ..... B65H 54/00; B65H 54/80; B65H 75/24

[58] Field of Search ..... 242/47, 82, 83, 110.1, 242/25 A; 28/21, 75; 19/159 R; 57/71, 68, 67

[56] References Cited

UNITED STATES PATENTS

| | | | |
|---|---|---|---|
| 373,463 | 11/1887 | Lenox | 242/83 X |
| 627,722 | 6/1899 | Edwards | 242/83 X |
| 1,825,865 | 10/1931 | Hays | 242/110.1 X |
| 1,870,954 | 8/1932 | Guenther et al. | 242/110.1 |
| 1,995,498 | 3/1935 | Dempsey et al. | 242/83 X |
| 2,321,646 | 6/1943 | Blodgett | 242/25 A X |
| 2,957,646 | 10/1960 | Crum | 242/83 X |
| 2,971,243 | 2/1961 | Burns | 28/21 |
| 2,971,683 | 2/1961 | Paulsen | 242/82 X |
| 3,449,901 | 6/1969 | Mackie | 57/71 |

*Primary Examiner*—Stanley N. Gilreath
*Attorney, Agent, or Firm*—Earle R. Marden; H. William Petry

[57] ABSTRACT

Method and apparatus to produce a dyed yarn package with qualities similar to that of a skein dyed yarn package. The method and apparatus incorporates a novel spindle onto which, preferably, high bulk yarns are wound under very little tension to provide a compact but loose yarn package which is amenable to efficient bulking and dyeing.

11 Claims, 10 Drawing Figures

INVENTORS
LARRY N. PEARCE
GRADY H. SANDERS
ATTORNEY

INVENTORS
LARRY N. PEARCE
GRADY H. SANDERS
Arthur L. Urban
ATTORNEY

INVENTORS
LARRY N. PEARCE
GRADY H. SANDERS
ATTORNEY

FIG.-7-
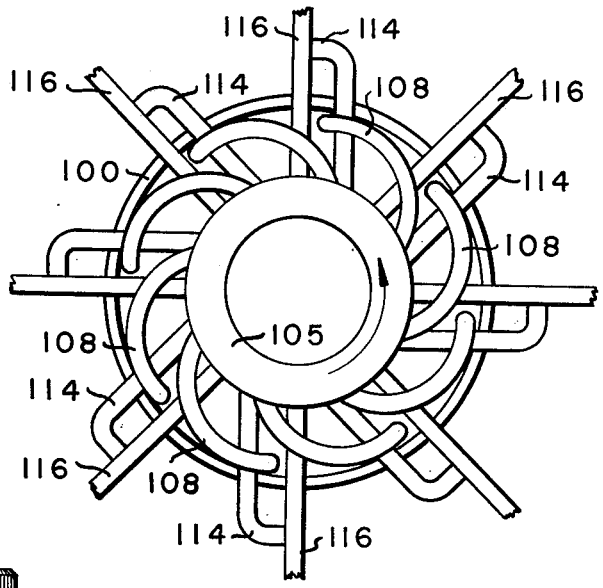
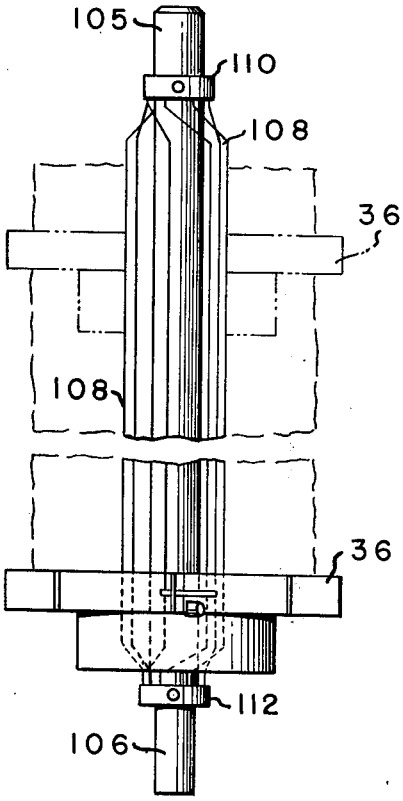
FIG.-6-
INVENTORS
LARRY N. PEARCE
GRADY H. SANDERS
Arthur L. Upton
ATTORNEY

INVENTORS
LARRY N. PEARCE
GRADY H. SANDERS
ATTORNEY

METHOD AND APPARATUS TO TREAT YARN

This is a division of application Ser. No. 776,534, filed Nov. 18, 1968, now U.S. Pat. No. 3,618,184.

Previous to this invention, several methods of bulking and dyeing of yarn were known to the industry including skein dyeing which produces a very high quality yarn. In skein dyeing the yarn to be bulked and dyed is wound into skein form from twister bobbins or shipping cones. The skeins are placed in a large carrier by draping the yarn over horizontally mounted poles called sticks. The skein will drape from a top stick and be located around a bottom stick, which is spaced downwardly from the top stick and upwardly from the bottom loop of the skein so that the yarn when relaxed will draw up and touch the bottom stick. The loaded carriers are then placed in the dye var to bulk and dye the yarn. The dyed yarn is then centrifuged to extract the liquid therefrom. From the centrifuge the yarn is then backwound onto a shipping cone on a skein-to-cone winder. This process provides a quality yarn which commands a premium price but the present technique of winding and backwinding of skeins is very inefficient resulting in a loss of machine efficiency and requires very skilled labor.

Another method to relax and dye high bulk yarn is by the conventional dyeing method in which the yarn is wound onto a dye tube, loaded onto carriers and dyed in a pressure kettle. As with the skein dyeing method the liquid is then extracted and the yarn backwound onto shipping cones by conventional means. This method provides yarn which is inferior to skein dyed yarns but employs efficient winding and backwinding. Further, since the yarn is pressure dyed, cycle times can be cut thereby increasing production. Also, since the package density of this method is greater than that of skein dyeing it is possible to obtain better space utilization of the dyehouse because of high loading per unit of floor area.

Therefore, it is an object of this invention to provide a package dyeing apparatus and method which produces a dyed yarn of quality similar to that of skein dyed yarn.

Another object of the invention is to provide a method and apparatus to produce a high quality high bulk dyed yarn.

Other objects and advantages will become apparent as the specification proceeds to describe the invention with reference to the accompanying drawings, in which:

FIG. 6 shows the spindle and wire guides in the position when the yarn is being wound;

FIG. 7 shows the wire guides in the position after doffing and before bulking;

As previously discussed, the improved method and apparatus are designed to enhance dyeability of any yarn that has the characteristic of being bulked. This characteristic may be defined as the ability of a yarn to contract lengthwise and at the same time expand radially to give a loose bulked appearance. There are a number of yarns which fall in this category such as Orlon, acrylics, high bulk Dacrons, viscose blends, etc. The herein disclosed method and apparatus has been found to be particularly attractive for bulking and dyeing of high bulk Orlon yarn in the manner shown in FIG. 1.

Figure 1:
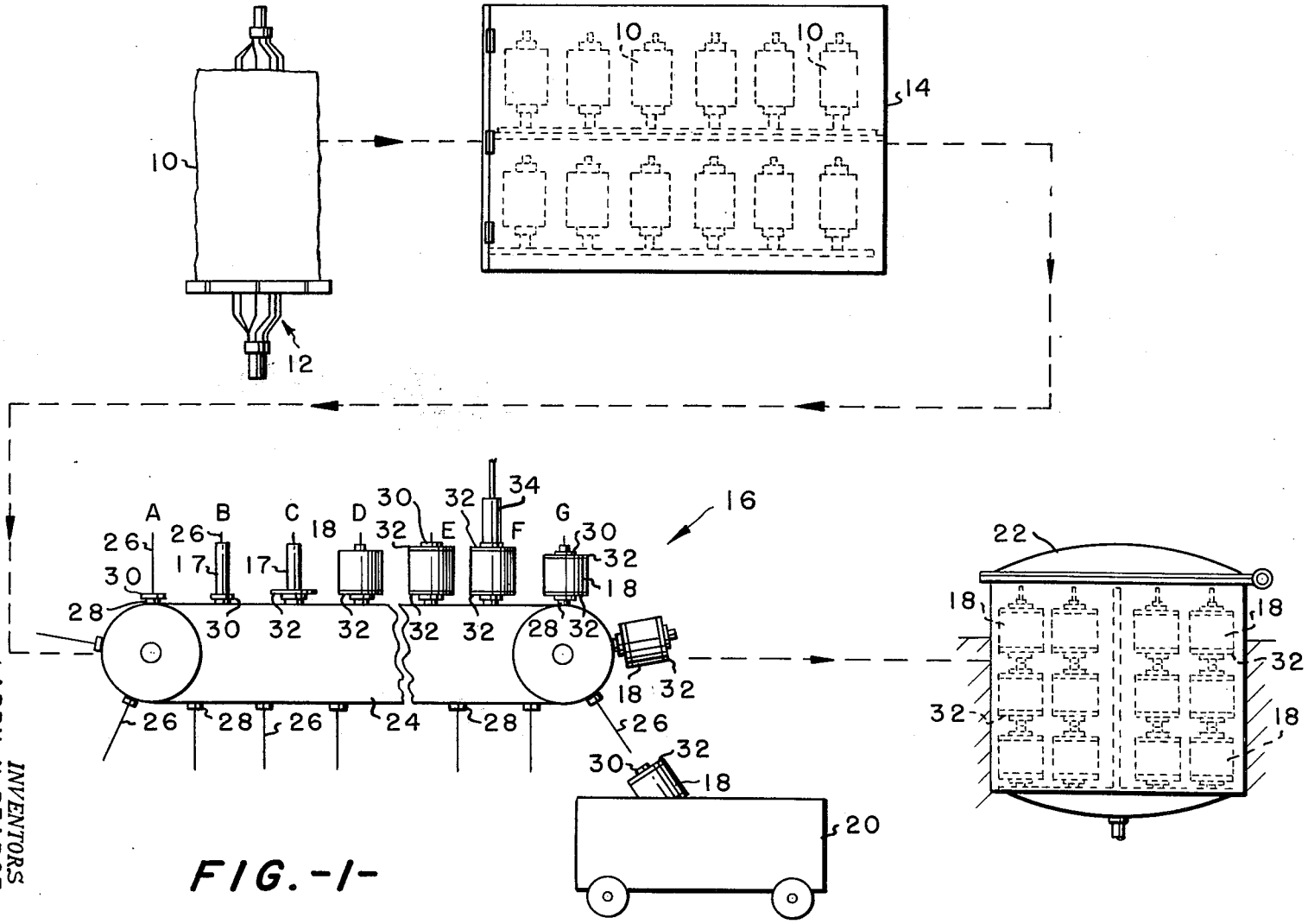
FIG. 1 is a schematic representation of the overall improved process.

In FIG. 1 the wound yarn package is indicated by the reference numeral 10 and is wound on the new and improved spindle assembly 12. The package 10 containing a yarn capable of being bulked such as Orlon is placed into a pressurized steam chamber 14 for bulking. After the yarn package 10 is bulked in the steam chamber 14, it is delivered to a transfer apparatus, generally denoted 16, wherein the bulked yarn is transferred to a dye tube 17 for dyeing. From the transfer apparatus 16 the new yarn package 18 is loaded into a doff truck 20 and conveyed to the dye beck 22 for dyeing.

The transfer apparatus 16 basically consists of an endless belt 24 to which is attached a plurality of upright spindles 26 having a stop plate 28 on the bottom therefrom. Starting at the entrance on left end of the top run of the belt 24 a series of operations are performed to produce the new improved package 18. At position A a lock plate 30 is telescoped over the spindle 26. At position B the dye tube 17 is telescoped over the spindle 26 with one end being inserted and held in a central opening in the plate 30. Then at position C a perforated yarn support plate 32 is telescoped over the dye tube 17. Then the spindle moves to position D where the bulked yarn is doffed from the spindle assembly 12 and placed on the dye tube 17. At position E a second perforated yarn support plate 32 is placed on top of the bulked yarn and a second lock plate 30 is placed on top of the second support plate 32. Then a pressure actuated member 34 is actuated at position F to engage the second lock plate 30 to reduce the height of the yarn package to provide the compact package 18 shown at position G.

Looking now to FIGS. 2–10, and especially to FIGS. 2 and 3, the new and improved winding technique will be explained. As discussed briefly before, it is proposed to provide a dye package which incorporates the advantages of a skein dyed package and a package dyed package. To this end, the package should be such that (1) the yarn pattern is such that the yarn can contract without tightening on itself, (2) the density of the package must be low to allow space for yarn movement while bulking and (3) the pattern must be such to allow easy and efficient winding and backwinding at an acceptable production rate. To this end, the winding pattern shown in FIG. 3 is employed wherein the yarn is delivered from a collar tube 34 in a helical pattern onto a turntable 36 so that the yarn forms a package composed of an ascending series of loops 37 which surround the center line of the turntable 36. This is basically accomplished by having the axis of the coiler tube eccentric to the axis of the spindle assembly 12 and rotating the coiler tube at a much greater rpm than the rpm of the turntable 36. To accomplish this result, the winding arrangement shown schematically in FIG. 2 is employed.

Figure 2:
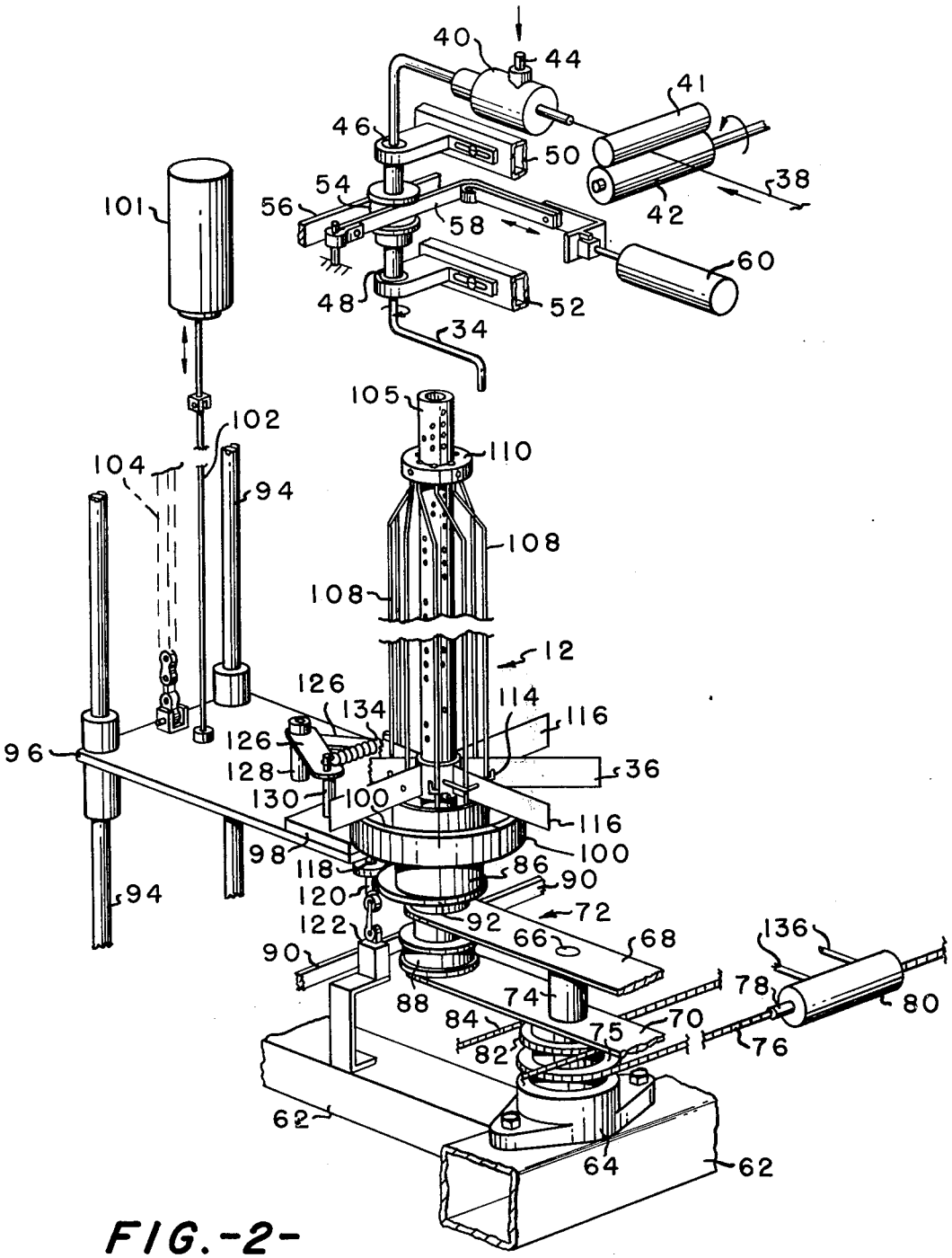
FIG. 2 is a schematic perspective view of a new and improved yarn winding apparatus used in the process.
Figure 4:
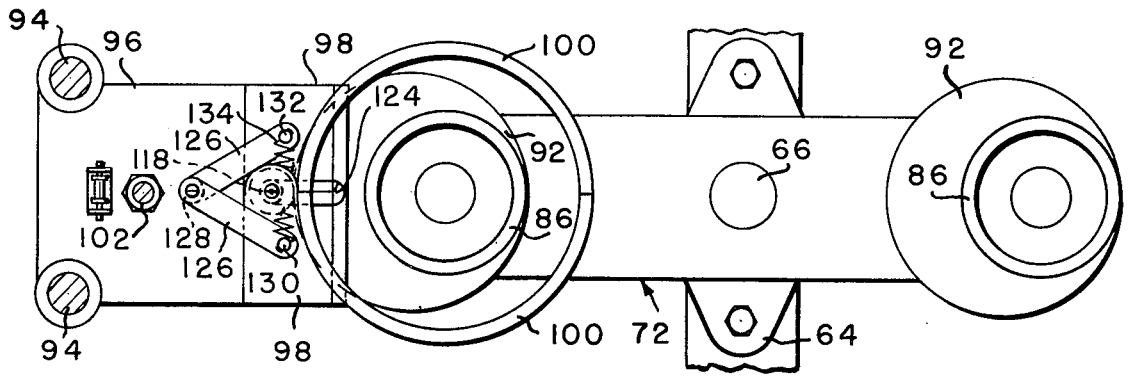
FIG. 4 is a top view of the spindle transfer mechanism in operative position.
Figure 3:
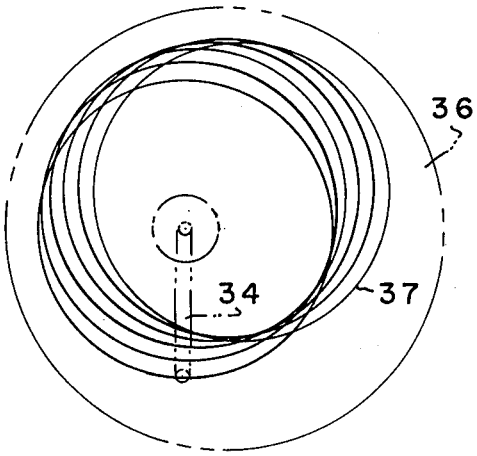
FIG. 3 is a schematic pattern of the yarn wound by the winder of FIG. 2.

FIG. 2 represents only one position of a multi-position frame on which yarn 38 to be bulked and dyed is delivered into the aspirator 40 by means of nip rolls 41 and 42 suitably driven. Air under pressure is supplied into the aspirator 40 via air inlet 44 and transports the yarn 38 through the rotating coiler tube 34. Coiler tube 34 is suitably supported in bearings 46 and 48 on support members 50 and 52, respectively, and can be adjusted relative thereto to position the outlet of the coiler tube 34 relative to the axis of the spindle 12. Located on the coiler tube 34 between the bearings 46 and 48 is a whorl 54 which is contacted by drive tape 56 to rotate the coiler head 34. Mounted adjacent the whorl 54 opposite the drive tape is a brake 58 suitably positioned by the piston 60 to stop the rotation of the coiler head 34 when desired.

The spindle assembly 12 is supported in a position under the coiler tube 34 on a suitable frame 62 to receive yarn from the coiler tube 34. Mounted on the frame 62 is a bearing block 64 which supports a shaft 66 that projects up through the upper and lower plates 68 and 70 of the pivot arm assembly 72. Surrounding the shaft 66 between the upper and lower plates 68 and 70 is a collar member 74 welded or otherwise secured to both plates 68 and 70 to maintain a spaced relationship between plates 68 and 70. Fixed to the shaft 66 through suitable means is a sprocket 75 which is engaged by a chain 76, which is connected to and driven by the piston rod 78 of double acting pneumatically operated piston 80. An idler gear 82 is rotatably supported with respect to the shaft 66 and is engaged by a chain 84 which moves the spindles of the next adjacent spindle position. In like manner the chain 76 engages an idler gear on the spindle of the next adjacent position opposite to the spindle engaged by chain 84.

Pivot arm assembly 72 at each position supports two spindles 12 so that one spindle can be operating while the other spindle is being doffed. Rotably supported in each end of the upper and lower plate members 68 and 70 is a spindle cup 86 to which a whorl 88 is fixed thereto for engagement by the spindle drive tape 90 which extends the length of the frame to simultaneously provide a drive means for all the spindle positions. A cam member 92 is connected to the bottom of the spindle cup 86 and rotates therewith for reasons hereinafter explained.

Slidably mounted on rods 94 adjacent the spindle assembly 12 is turntable traverse plate 96 which controls the build of yarn on the spindle. Pivotally mounted on the traverse plate 96 are two plate members 98 to which are attached the semi-circular segments 100 which when mated, as in FIG. 2, support the turntable 36 in a predetermined position. The position of the plate 96 is controlled by a pneumatically operated piston 101 which exerts a downward force on the plate 96 through linkage 102 and let-off chain 104 which allows the plate 96 to be lowered at a predetermined rate under the pressure exerted by the piston 101.

Figure 9:
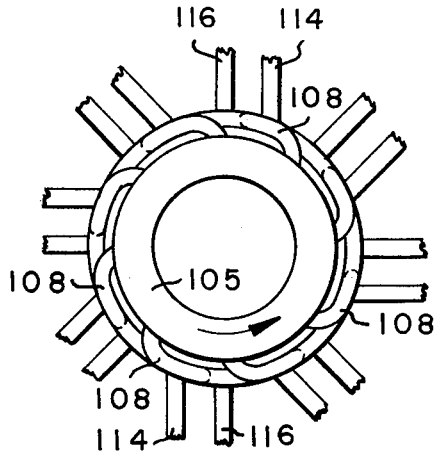
FIGS. 8 and 9 show the spindle and wire guides in the position after the yarn has been wound and is ready to be bulked.
Figure 8:
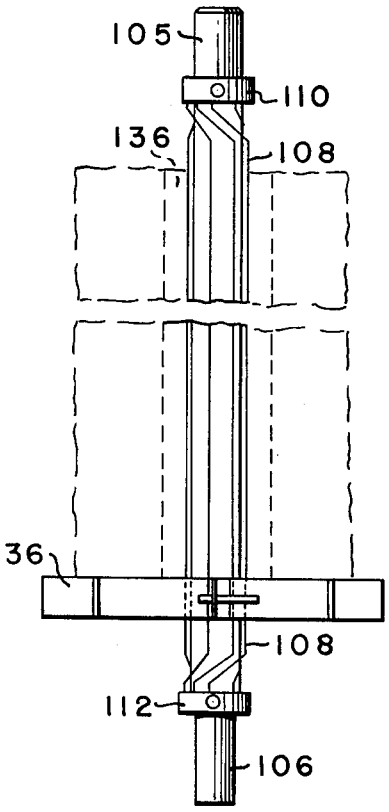
Figure 10:
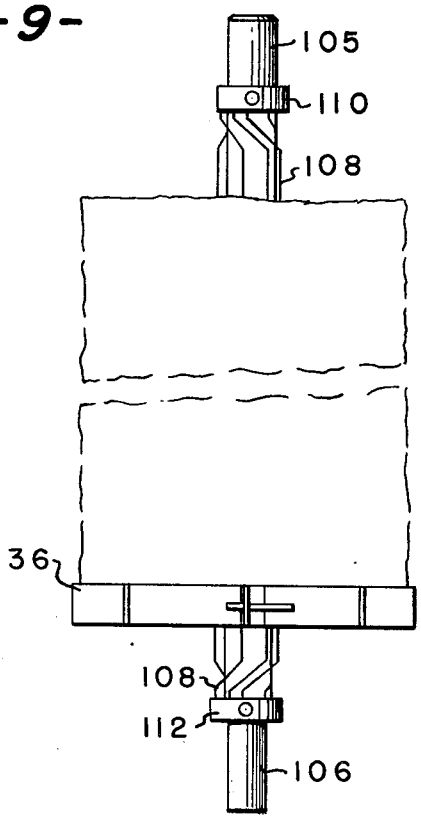
FIG. 10 shows the spindle and yarn after the yarn has been bulked.

The spindle assembly 12 basically consists of the turntable 36, the spindle cup 86, a perforated cylindrical center member 105 which has a solid end portion 106 which slidably engages a hollow projection in the bottom of the cup to hold the spindle upright, a plurality of elongated slender wire members 108 which are rotably secured in the upper and lower retaining collars 110 and 112 secured on the center member 105 by suitable means such as set screws. The wire members 108 normally assume the operating position as shown in FIGS. 2 and 6 or are rotated to outward extreme position where they engage the ends of the L-shaped members 114, welded or otherwise secured to the legs 116 of the turntable or are rotated to a position flush with the cylindrical center member 105, as shown in FIGS. 8–10.

OPERATION

In normal operation air is supplied continuously to the aspirator 40 and the supply of yarn 38 to be bulked and dyed is controlled by the nip rolls 41 and 42 which are started and stopped automatically by a suitable control system (not shown). FIG. 2 represents the spindle when pivot arm assembly has rotated to a position where whorl 88 has been contacted by the drive tape 90 and the cam member 92 has contacted the pivot pin 118 and pushed it to the rear position (FIG. 4) to close the semi-circular elements 100 under the turntable 36. The coiler tube 34 is not in operation and yarn is not being supplied to the aspirator. Since the spindle 12 is rotating the wire members 108, due to the drag of the turntable 36 on the segments 100 are pivoted out to position shown in FIGS. 2 and 6 wherein the bottoms of the wire members 108 are restricted by further outward movement by the inside diameter of the spindle cup 86.

Then when it is desired to build a yarn package, the turntable 36 is raised to the position shown in phantom in FIG. 6 by actuation of the air-cylinder 101, thereby raising the turntable traverse plate 96 and causing the semi-circular elements 100 to be raised pushing the turntable 36 upward to the indicated position. Then the brake 58 is released and the nip rolls 41 and 42 are actuated to supply yarn to the aspirator 40. As described previously, the coiler tube 34 rotates at a rate considerably faster than the turntable and spindle to provide an ascending series of yarn loops. In the preferred form of the invention the rotation of the coiler tube 34 is on the order of 2200 rpm while the spindle is rotating at a rate of 15 rpm in order to lay a considerable number of loops for any one vertical position of the turntable 36. Then to provide height to the package the let-off chain 104 allows the traverse plate 96 to drop at a predetermined rate under the pressure from the pneumatically actuated piston 101. The traverse plate 96 and turntable 36 descend until the switch actuator 120 engages the switch 122 mounted in any suitable manner. When switch 122 is actuated the brake 58 will be engaged to slow the rotation of the coiler tube 34 and to disconnect the drive of the nip rolls 41 and 42. The yarn 38 being supplied to the spindle will then tend to form small loops around the top of the center spindle member and be broken as the tension on the yarn increases due to the decrease of yarn supply to the coiler tube 34 since the nip rolls 41 and 42 are no longer operative and the spindle 12 continues to rotate at its normal speed.

As briefly discussed before, the semi-circular segments 100 are welded or otherwise secured to the plates 98 which are pivotally connected to the pivot pin 118. The pivot pin 118 is slidably movable in the slot 124 in the traverse plate 96. A pair of lever arms 126 are pivotally secured at one end to a post 128 secured to the top surface of the traverse plate while one end of one lever arm 126 is pivotally secured to a post 130 secured to one plate 98 and the other lever arm 126 is pivotally secured to another post 132 secured to the other plate 98. Secured to the posts 130 and 132 is a spring member 134 biasing the plates 98 toward one another.

Figure 5:
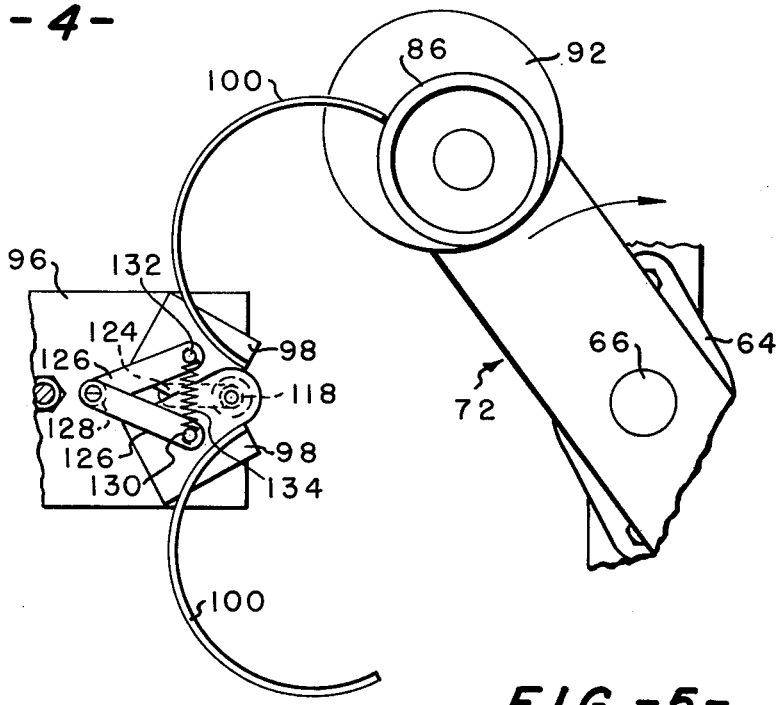
FIG. 5 is a view similar to FIG. 4 showing a spindle being transferred.

When the package is completed on the spindle 12 and is ready to be doffed, an empty spindle will be placed in the spindle cup 86 of the other spindle position on the pivot arm assembly 72 and air will be supplied to air inlet 136 of the piston 80 to cause the chain 76 to move in the clockwise direction to rotate both the full package spindle and the empty spindle in the clockwise direction. As the full package starts to rotate the spindle cup 86 will engage one of the semi-circular elements 100 causing the segments 100 to open, thereby pivoting the plates 98 against the bias of the spring 134. At the same time, the pivot pin 118 will be slid toward the semi-circular segments in the slot 124 due to the pivotal movement of the plates 98. When the pivot pin 118 slides beyond the middle of the slot the spring 134 will cause the segments 100 to open all the way and be locked in the open position since the pivot pin will be forced or slid into the forward position as shown in FIG. 5. The pivot arm assembly will continue to rotate clockwise 180° until the empty spindle moves into position under the coiler head 34 and the cam 92 engages the pivot pin 118 and forces it rearwardly to close the semi-circular segments 100 under the turntable 36 in preparation for winding a new yarn package.

The newly wound yarn package which is now in the empty spindle position is now removed from the spindle cup 86 and the wire members 108 are now pivoted to the extreme outward position where they engage the ends of the L-shaped members 114 to firm up the newly wound packages (FIG. 7). Then the wire members are rotated inwardly adjacent the hollow center member 105 as shown in FIGS. 8 and 9 to provide a space indicated as 136, around the spindle to allow the yarn to bulk when placed into the pressurized steam chamber 14. Then the yarn package is placed in the steam chamber 14 and is therein bulked to produce the package shown in FIG. 10. It should be noted that the bulked yarn package tends to be reduced in height during bulking since the length of yarn is normally shortened during bulking. The bulked yarn package is then further processed in the manner hereinbefore explained.

It can be readily seen that the yarn package produced by this method and apparatus has both the characteristics of a skein dyed yarn package and the characteristics of a conventional wound package. This invention provides a yarn package in which the yarn is wound in a loose compact configuration which can be readily bulked and dyed.

Although we have described in detail the preferred embodiment of our invention, we contemplate that changes may be made without departing from the scope or spirit of our invention and we desire to be limited only by the scope of the claims.

That which is claimed is:

1. Apparatus to provide a substantially tensionless yarn package comprising: a turntable, means rotably supporting said turntable, a spindle operably associated with said turntable, a rotably supported fiber supply means mounted above said spindle and said turntable, means to supply fiber to said fiber supply means and means operably associated with said turntable to lower said turntable at a predetermined rate, said spindle comprising a hollow center member, collar members secured to said center member at the top and bottom thereof, and a plurality of wire members pivotally secured in said collar members.

2. Apparatus to provide a substantially tensionless yarn package comprising: a support member, a rotably mounted spindle cup mounted on said support member, a spindle member mounted in said cup, a turntable operably associated with said spindle member, said spindle member projecting upwardly from said spindle cup, means to rotate said spindle cup, a yarn coiler head mounted above said spindle to supply yarn around said spindle, means to rotate said coiler head around said spindle at a speed greater than one hundred times the speed of said spindle cup, means supplying fiber to be wound to said coiler head and means operably associated with said turntable to lower said turntable at predetermined intervals to provide a plurality of layers of fibers.

3. Apparatus to provide a substantially tensionless yarn package comprising: a support member, a rotably mounted spindle cup mounted on said support member, a spindle member mounted in said cup, a turntable operably associated with said spindle member, said spindle member projecting upwardly from said spindle cup, means to rotate said spindle cup, a yarn coiler head mounted above said spindle, means to rotate said coiler head around said spindle, means supplying fiber to be wound to said coiler head and means operably associated with said turntable to lower said turntable at predetermined intervals to provide a plurality of layers of fibers, said spindle including a collar member fixed to the top and bottom of said spindle and a plurality of wire members pivotally supported at their ends in said collar members.

4. The structure of claim 3 wherein said wire members are supported in said spindle cup, said spindle cup having a diameter less than the diameter of the wire members when pivoted to their outward position and thereby restricting the outward movement of said wire members.

5. The structure of claim 4 wherein said means to lower said turntable includes a platform, said platform having a pair of semi-circular segments attached thereto and projecting under said turntable to support said turntable.

6. The structure of claim 5 wherein said platform contains means to pivotally support said semi-circular segments whereby said segments can be pivoted out from under said turntable.

7. The structure of claim 5 wherein means are provided to bias said platform in a downward direction and a further means is operably associated with bias to allow the biasing means to lower said platform.

8. The structure of claim 7 wherein said means providing a supply of fibers includes an aspirator provided with air under pressure.

9. Apparatus to provide a substantially tensionless yarn package comprising: a turntable, means rotably supporting said turntable, a spindle operably associated with said turntable, a rotably supported fiber supply means mounted above said spindle and said turntable, means to supply fiber to said fiber supply means, means to rotate said fiber supply means at a speed at least one hundred times greater than said turntable to supply fiber to said turntable around said spindle and means operably associated with said turntable to lower said turntable at a predetermined rate, said means to supply fiber to said fiber supply means including an aspirator supplied with air under pressure.

10. The structure of claim 9 wherein said air under pressure is supplied continuously.

11. Apparatus to provide a substantially tensionless yarn package comprising: a turntable, means rotably supporting said turntable, a spindle operably associated with said turntable, a rotably supported fiber supply means mounted above said spindle and said turntable, means to supply fiber to said fiber supply means and means operably associated with said turntable to lower said turntable at a predetermined rate, said means to lower said turntable including a platform, said platform having a pair of semi-circular segments attached thereto and projecting under said turntable to support said turntable, said platform containing means to pivotally support said semi-circular segments whereby said segments can be pivoted out from under said turntable.

* * * * *

UNITED STATES PATENT OFFICE

CERTIFICATE OF CORRECTION

Patent No. 3,964,691 Dated June 22, 1976

Inventor(s) Larry N. Pearce et al.

It is certified that error appears in the above-identified patent and that said Letters Patent are hereby corrected as shown below:

Column 2, line 61, "collar" should read --coiler --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*